US007779745B2

(12) United States Patent
Porel

(10) Patent No.: US 7,779,745 B2
(45) Date of Patent: Aug. 24, 2010

(54) AUTOMATIC-LOCKING HYDRAULIC JACK

(75) Inventor: Louis-Claude Porel, Jeanmenil (FR)

(73) Assignee: Hydro Leduc, Azerailles (FR)

( * ) Notice: Subject to any disclaimer, the term of this patent is extended or adjusted under 35 U.S.C. 154(b) by 225 days.

(21) Appl. No.: 11/882,933

(22) Filed: Aug. 7, 2007

(65) Prior Publication Data

US 2008/0054239 A1 Mar. 6, 2008

(30) Foreign Application Priority Data

Sep. 6, 2006 (FR) ..... 06 07819

(51) Int. Cl.
*F15B 15/26* (2006.01)

(52) U.S. Cl. ..... 92/19

(58) Field of Classification Search ..... 92/19
See application file for complete search history.

(56) References Cited

U.S. PATENT DOCUMENTS 3,665,812 A * 5/1972 Hashimoto et al. ..... 92/24
5,355,707 A 10/1994 Inoue et al.
5,957,443 A 9/1999 Mascola

FOREIGN PATENT DOCUMENTS

| | | |
|---|---|---|
| DE | 31 13 894 A1 | 11/1982 |
| EP | 1 079 117 A1 | 2/2001 |
| FR | 2 196 877 A | 3/1974 |

* cited by examiner

*Primary Examiner*—F. Daniel Lopez
(74) *Attorney, Agent, or Firm*—Young & Thompson

(57) ABSTRACT

An automatic-locking hydraulic jack has a piston (1, 30) that slides into a cylinder (3-2, 32). Locking of the piston is achieved by elastic deformation of either the inside wall (2) of the cylinder or of the outside wall of the piston (30) so as to ensure that the one is tightly clamped over the other. The locking of the jack is maintained by pressure that causes the elastic deformation of the inside wall of the cylinder (3-2) or of the outside wall of the piston (30), until the jack is unlocked by neutralizing the elastic deformation.

5 Claims, 4 Drawing Sheets

AUTOMATIC-LOCKING HYDRAULIC JACK

This invention relates to a hydraulic jack that is equipped with means that make it possible to lock it at any point in its travel.

It is often necessary to keep a hydraulic jack in position regardless of its load and for a very long time.

The known mechanical locking means are expensive and complex.

This invention solves the problem of a hydraulic jack locking, regardless of its position and for as long as necessary.

The Patent DE 31 13 894 of Nov. 11, 1982 describes a jack whose cylinder comprises a portion whose inside wall can deform elastically under the action of hydraulic pressure to lock the rod of the piston by tight clamping; a piston whose rod comprises a bore in which a rod, also hollow and connected to an outside pressure source, moves—whereby this rod comprises a part that can deform under the action of said pressure—is also described therein.

French Patent 2,196,877 of Aug. 2, 1973 describes a jack that comprises a cylinder whose wall is deformed by an outside pressure so as to lock the piston by tight clamping.

Similar devices are described in U.S. Pat. No. 5,355,707 of Aug. 14, 1992; U.S. Pat. No. 5,957,443 of Sep. 28, 1999, and EP 1,079,117 of Feb. 28, 2001.

These devices are not satisfactory when it is necessary to keep a hydraulic jack in position for a very long time regardless of its load because it is, in practice, almost impossible to have a leak-free hydraulic system, such that, in the long run, the jacks that are described above wind up being unlocked.

This invention has as its object to provide a jack that remains locked and that is only unlocked upon command.

This jack is of the type in which the locking of the piston is achieved by elastic deformation either of the inside wall of the cylinder or of the outside wall of the piston, so as to ensure that the one is tightly clamped over the other, and it is characterized by the fact that the locking is stably maintained by means of pressure that causes the elastic deformation of the inside wall of the cylinder or of the outside wall of the piston, whereby the unlocking of said jack is achieved by neutralizing this stable deformation.

According to a first embodiment of the invention, the locking is achieved stably by the elastic deformation either of the cylinder or of the piston under the action of an airtight chamber that is permanently filled with a compressed neutral gas, whereby the unlocking is achieved by hydraulic pressure that intervenes between the piston and the cylinder so as to exert an antagonistic counter-pressure that neutralizes the elastic deformation caused by the compressed neutral gas.

According to a second embodiment of the invention, the locking is achieved stably by elastic deformation of the outside wall of the piston under the action of hydraulic pressure that is exerted stably by an hydraulic accumulator, placed inside the piston, whereby the action of this hydraulic accumulator is halted by a mechanical command, which neutralizes the elastic deformation of the wall of the piston.

By way of example and to facilitate the understanding of the invention, in the accompanying drawings.

Figure 1:
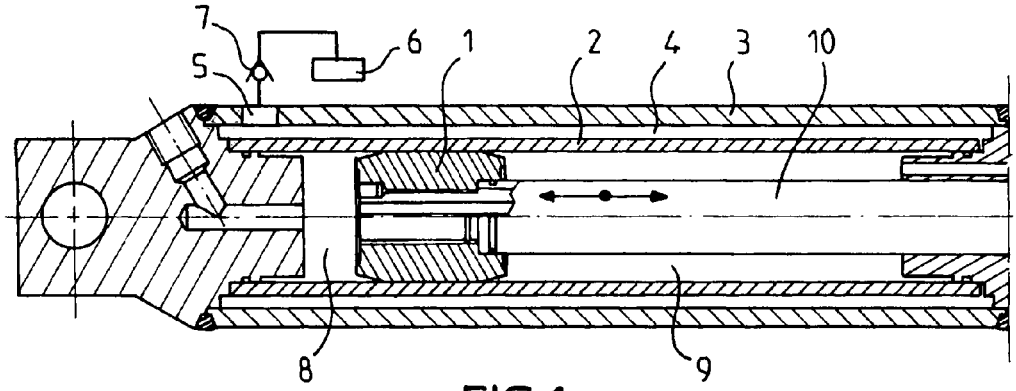
FIG. 1 shows a diagrammatic view, in longitudinal section, of an embodiment of a jack according to the invention.

By referring to the figures, it is seen that according to a first embodiment of the invention, the hydraulic jack comprises a piston 1 that moves in a cylinder that consists of two co-axial tubes 2 and 3 that provide between them a cylindrical annular space 4.

Said annular space 4 is connected to a compressed gas source 6 through a non-return valve 7, such that the chamber 4 is a closed, airtight space, whereby the pressure of the gas is permanent.

In FIG. 1, it is seen that the piston 1 and its rod 10 can move freely inside the inside tube 2.

Figure 2:
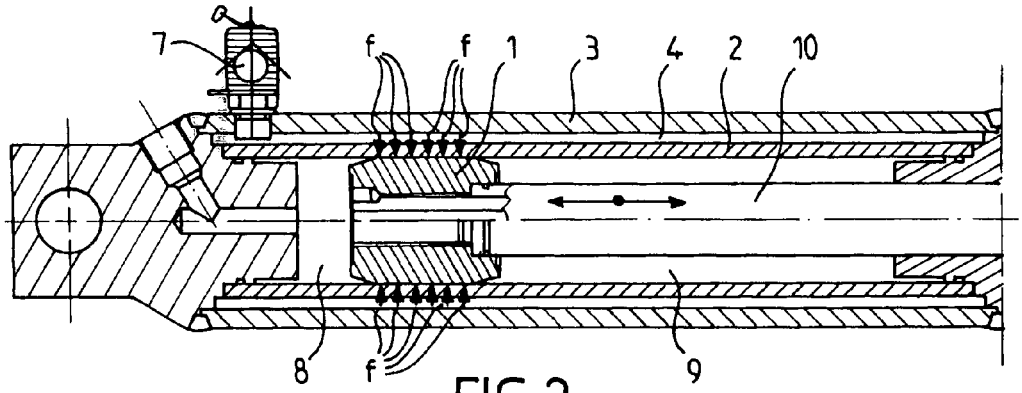
FIG. 2 shows a view of the jack of FIG. 1 illustrating the locked jack of FIG. 1.

In FIG. 2, it is seen that after the compressed gas is introduced into the annular space 4, the tube 2 will exert a tight clamping action on the piston 1, along the arrows f, which will create an elastic deformation of the wall of the inside tube 2, which will tightly clamp the piston 1 and immobilize it.

When compressed hydraulic fluid is introduced into one or the other of the chambers 8 or 9, located on both sides of the piston, which does not comprise a seal, this liquid will intervene between the wall 2 of the cylinder and the outside wall of the piston 1 by creating a counter-pressure that neutralizes the deformation of said wall 2.

Figure 3:
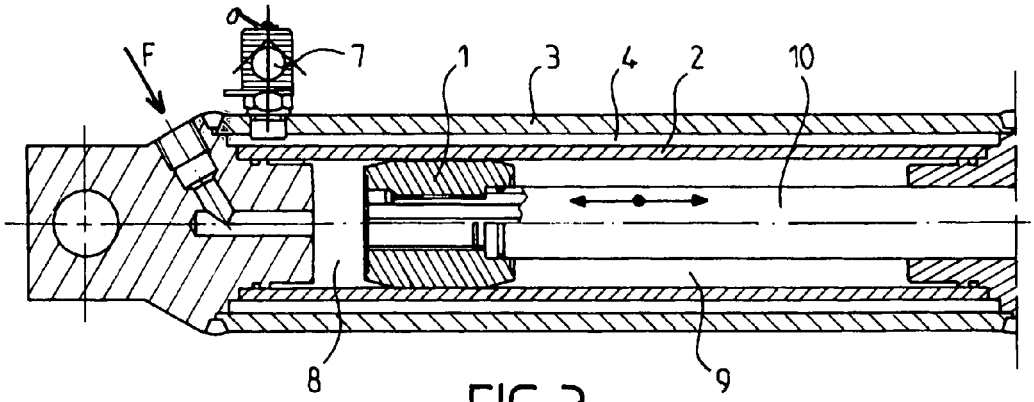
FIG. 3 shows a view of the unlocked jack of FIG. 2.

If reference is made to FIG. 3, it is seen that it may happen—when the piston is in the vicinity of one of the ends of the double cylinder 2/3 and when a compressed fluid is introduced into the chamber 8, for example—that the portion of the tube 2 that is located on the other side of the piston, in the chamber 9, is not pushed back enough and that the locking is at least partially maintained.

To prevent this, it is advantageously possible to arrange a slight leakage from one to the other of the chambers by a very slight play allowing the presence of a film of oil (or another hydraulic fluid) or else by a spiral groove.

The deformation of the inside tube 2 is based on the thickness of the wall of this tube, the metal that is used, and the pressure of the gas that is blown into the space 4. These parameters are set based on the usage for which the jack is designed.

The extent of the locking force of the piston 1 is based on the pressure of the gas and the size of the surfaces in contact. These parameters will also be set based on the usage for which the jack is designed.

It is therefore possible, thanks to this arrangement:

to lock the piston in any position to set the locking force at any value desired and to unlock the piston very easily.

In addition, it turns out that it becomes possible to produce a jack that is equipped with a piston without a seal because as soon as the pressure of the fluid eliminates the tight clamping of the tube 2 on the piston 1, the latter can move freely, which makes it possible to allow a very slight play between the piston 1 and the tube 2.

Figure 4:
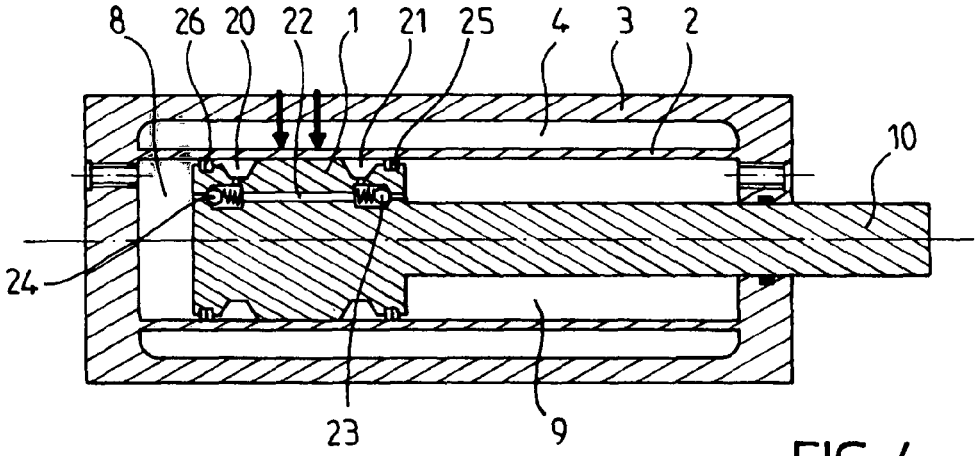
FIG. 4 shows a diagrammatic view, in longitudinal section, of a variant embodiment of the jack according to FIG. 1, whereby the jack is locked.
Figure 5:
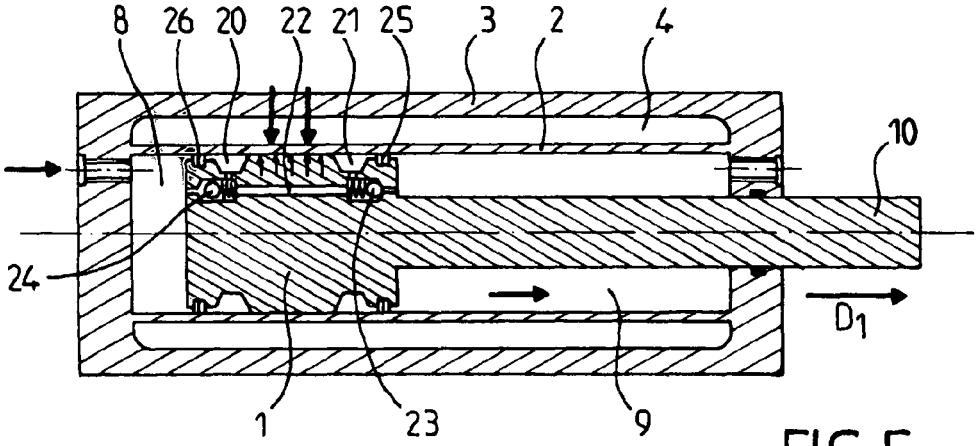
FIG. 5 shows a view of the jack of FIG. 4, whereby the jack is unlocked and pushed to the left of the figure.
Figure 6:
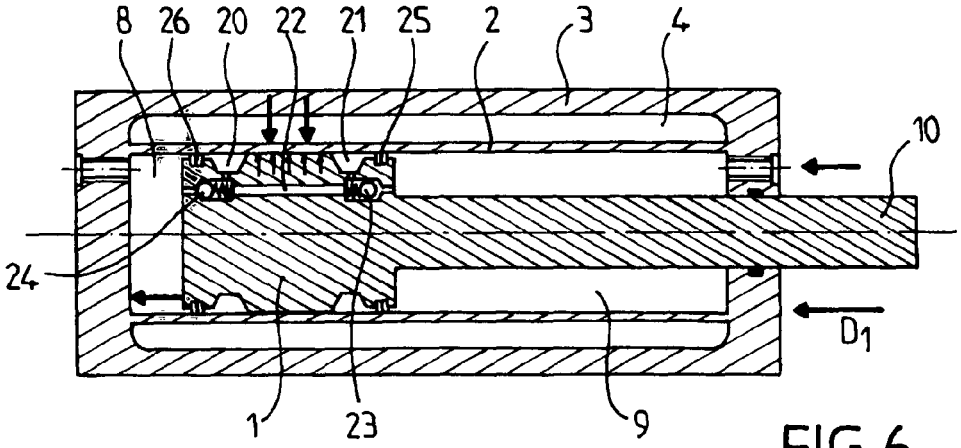
FIG. 6 shows a view of the jack of FIG. 4, whereby the jack is unlocked and pushed to the left of the figure.

FIGS. 4 to 6 relate to a variant embodiment of the automatic-locking jack.

With a jack according to FIGS. 1 to 3, it may arise that the hydraulic fluid that is introduced under pressure, either into the large chamber 8 or into the small chamber 9, does not intervene sufficiently in the play between the peripheral wall of the piston 1 and the inside wall of the cylinder 2 such that the antagonistic counter-effort, designed to unlock the jack, is not adequate or takes too much time to implement.

The object of the variant that is illustrated in FIGS. 4 to 6 is to eliminate this drawback.

In these figures, the same elements bear the same references.

At each of its ends, the piston 1 bears sealing segments 25-26 that are similar to the segments that are used in the internal combustion engines.

Two annular grooves 20 and 21, which are connected to one another via a pipe 22, which communicates with the chambers 8 and 9 of the jack via the anti-return valves 23 and 24 in reversed positions, are provided in these two groups of sealing segments 25 and 26.

The operation of this jack is described below.

In "locked" position (FIG. 4), the cylindrical annular chamber 4, which is permanently filled with a compressed neutral gas (nitrogen), causes the elastic deformation of the inside tube 2, whose wall is relatively thin and deformable.

The piston 1 is then wedged by the tight clamping exerted by the pressure of the gas and can no longer move.

In FIG. 5, the chamber 8 is fed by compressed hydraulic fluid via the pipe Pa. This liquid pushes the non-return valve 24 and, via the duct 22, feeds the grooves 20 and 21, which makes it possible for the antagonistic counter-pressure to be implemented over the entire periphery of the piston 1 in order to neutralize the effect of the pressure of the gas encompassed in the chamber 4, such that the piston 1 is unlocked and can move in the direction D1.

The sealing segments 25 and 26 allow one another a slight leakage at the beginning of the exerting of pressure: this leakage, being added to the introduction of compressed liquid via the grooves 20 and 21, facilitates the appearance of a compressed oil film between the wall of the piston 1 and that of the tube 2.

In FIG. 6, the small chamber 9 is fed by compressed liquid: the operation is identical to that of FIG. 5 but in reverse; the piston is unlocked and moves in the direction D2.

FIGS. 7 to 10 show another embodiment of the invention that operates in reverse, i.e., it is no longer the cylinder that tightly clamps the piston by retracting elastically, but the piston that is tightly clamped against the wall of the cylinder by dilating.

Figure 7:
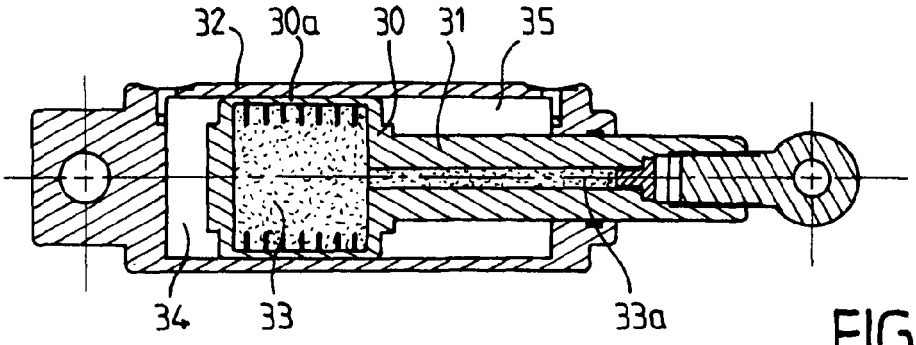
FIGS. 7 to 10 show four figures that illustrate a second embodiment of the invention in four different positions.

FIG. 7 illustrates a first locking position of the jack.

The piston 30, carried by a rod 31, can slide into a cylinder 32. The piston is hollow and comprises a chamber 32 that is filled with a compressed neutral gas. The wall 30*a* that surrounds the chamber 33 is relatively thin and deformable: under the action of the pressure of the gas that is found in the chamber 33, this wall 30*a* deforms and is applied against the inside wall of the cylinder 32 such that the piston is locked.

Figure 8:
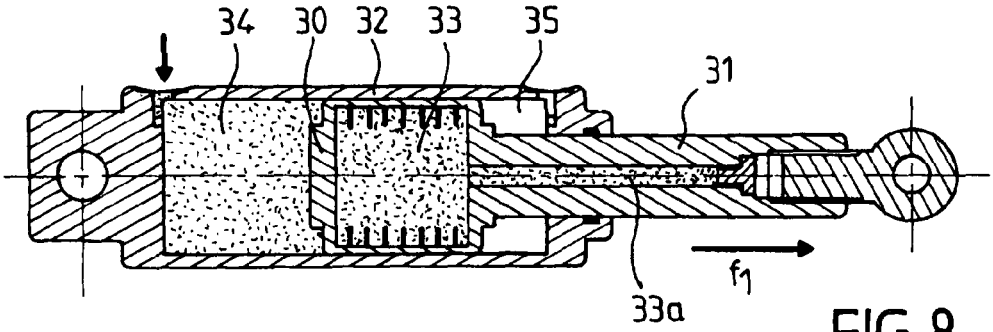

In FIG. 8, it is seen that the compressed hydraulic fluid was introduced into the chamber 34. This compressed hydraulic fluid intervenes between the wall 30*a* of the piston 30 and the inside wall of the cylinder 32 by creating an antagonistic counter-pressure that neutralizes the deformation of said wall 30*a*, which releases the piston 30 that can move along the arrow f1.

Figure 9:
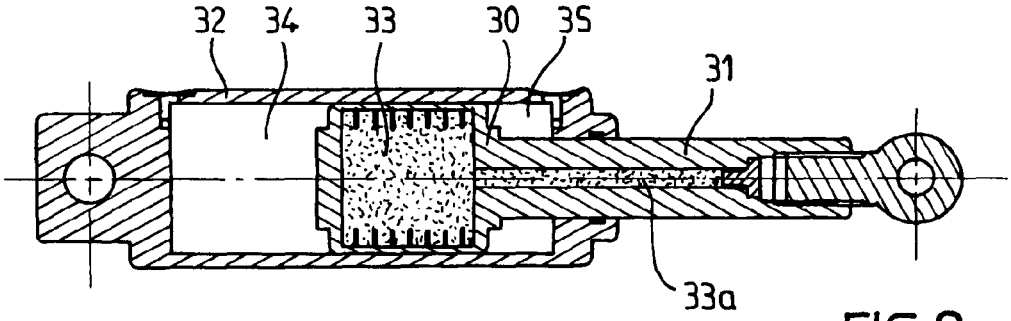

In FIG. 9, the hydraulic pressure was eliminated in the chamber 34; the result is that the wall 30*a* of the piston 30 deforms and the latter is again locked as in the case of FIG. 7.

Figure 10:
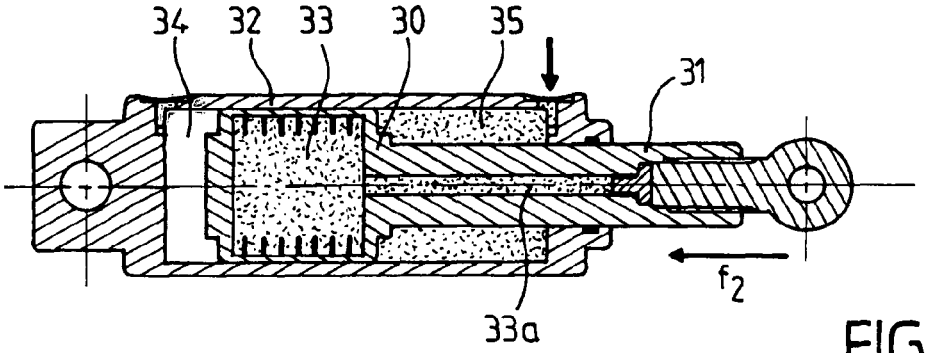

In FIG. 10, the hydraulic pressure is introduced into the small chamber 35. The compressed hydraulic fluid intervenes between the wall 30*a* of the piston 30 and the inside wall of the cylinder 32 by creating an antagonistic counter-pressure that neutralizes the deformation of said wall 30*a*, which releases the piston 30 that can move along the arrow f2.

To facilitate the forward motion of the compressed hydraulic fluid between the wall 30*a* and the inside wall of the cylinder, it is possible to engrave small grooves on the wall 30*a* that facilitate the forward motion of the compressed hydraulic fluid.

In all of the examples that are described, the chambers 4 or 33 are permanently pressurized, closed, airtight spaces, but it is also possible to use a non-return valve such as the valve 7 of the FIGS. 2 and 3 or to use one of them in the pipe 33*a*, located in the rod of the piston to neutralize the pressure of the gas.

It is also possible to replace the gas under a set pressure by variable compressed gas or fluid that is controlled by an outside circuit that is connected to the jack.

This type of jack will be used in all of the cases where a jack should hold a load without changing position for a very long period.

By way of nonlimiting example, such a jack can advantageously be used for the positioning of a mobile radar, such that, once the radar is regulated, its position is kept constant.

In all of the examples that are shown, the locking of the piston is achieved by the fact that the gas-filled chamber is airtight and permanently filled with compressed gas, but it is quite obvious that it is possible to achieve the unlocking either by neutralizing the gas pressure via a suitable valve or by replacing the gas pressure by a variable and controlled gas or fluid pressure.

Figure 11:
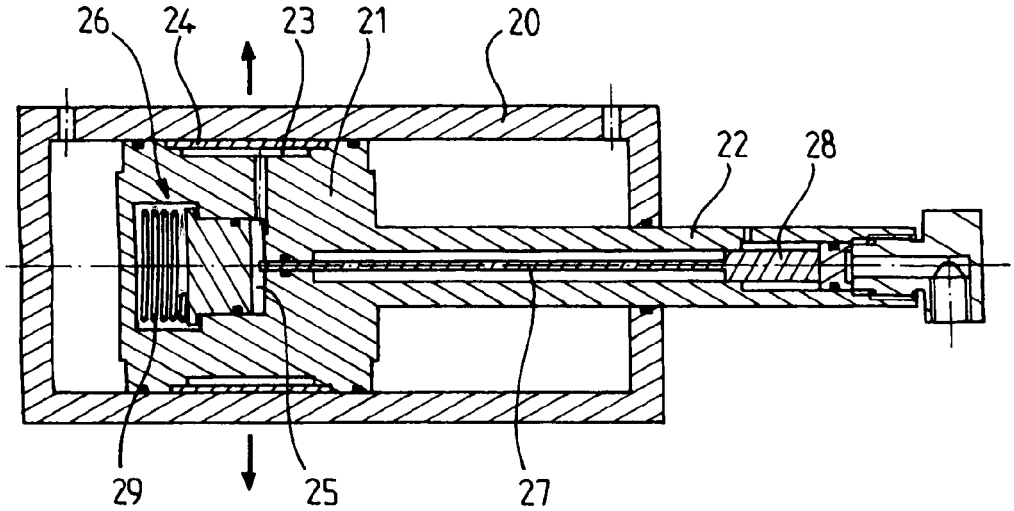
FIGS. 11 and 12 show two views that illustrate a third embodiment of the invention: one in locked position and the other in unlocked position.
Figure 12:
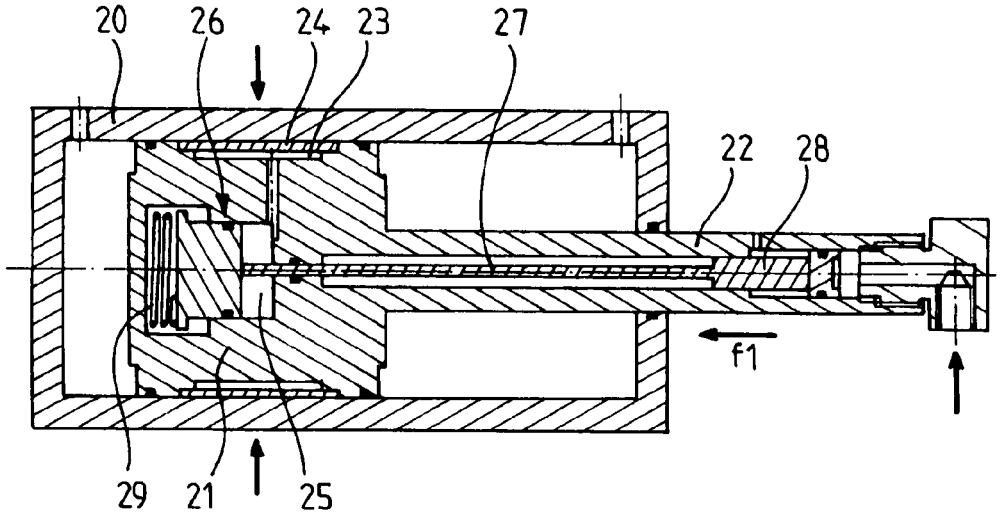

FIGS. 11 and 12 illustrate a third embodiment of the invention.

The jack consists of a cylinder 20, into which a piston 21 that is integral with a rod 22 slides.

The piston 21 comprises an annular chamber 23 whose annular wall 24, in contact with the inside wall of the cylinder 20, is elastically deformable.

This annular chamber 23 is linked with the chamber 25 of an hydraulic accumulator 26, placed inside the piston 21.

A mechanical means, constituted by a rod 27 that slides inside the rod 22 of the piston 21, can push back the moving element of the accumulator 26 against its spring 29.

The movement of this rod 27 can be caused by any suitable device, but in the example shown, it is caused by a small piston 28, integral with the rod 27, controlled hydraulically.

In FIG. 11, it is seen that the spring 29 has completely pushed back the moving element of the accumulator 26, causing a high hydraulic pressure to prevail in the chamber 25, and said pressure is transmitted to the annular chamber 23, which has the effect of deforming the wall 24 and therefore of locking the piston 21 in its cylinder 20.

In FIG. 12, it is seen that the small piston 28 is moved along the arrow f1 such that the rod 27 has pushed back the moving element of the accumulator 26 by compressing the spring 29. The result is that the pressure in the chamber 25 is decreased, therefore also in the chamber 23, such that the deformation of the wall 24 has disappeared, which has unlocked the piston 21.

The invention claimed is:

1. Automatic-locking hydraulic jack comprising a piston (1, 30) that slides into a cylinder (3-2, 32), in which the locking of the piston is achieved by elastic deformation of the outside wall of the piston (30) so as to ensure that the piston is tightly clamped within the cylinder, characterized by the fact that the locking of the jack is achieved by means of pressure that causes the elastic deformation of the outside wall of the piston (30), whereby the unlocking of said jack is achieved by neutralizing this deformation, wherein the piston (30) comprises an airtight chamber that is permanently filled with a compressed neutral gas that effects said elastic deformation, and wherein unlocking is achieved by a hydraulic pressure that intervenes between the piston (1, 30) and the cylinder (3-2, 32) and exerts an antagonistic counter-pressure that neutralizes the elastic deformation that is caused by the compressed neutral gas.

2. Automatic-locking hydraulic jack according to claim 1, wherein the hydraulic pressure that intervenes between the piston (1, 30) and the cylinder (3-2, 32) to ensure an antagonistic counter-pressure is a controlled variable hydraulic pressure.

3. Hydraulic jack according to claim 1, wherein said cylinder (32) is non-deformable and wherein the elastic deformation of the piston (30) that locks said piston against the inside wall of the cylinder (32) is neutralized by the hydraulic pressure that is introduced into one or the other of two chambers (34, 35) of the jack, which intervenes between the outside wall (30*a*) of the piston (30) and the inside wall of the cylinder (32).

4. Hydraulic jack according to claim 3, wherein the outside wall (30*a*) of the piston (30) is equipped with grooves that facilitate the forward motion of the compressed hydraulic liquid.

5. Hydraulic jack according to claim 3, wherein the chamber (33) of the piston is connected to a pipe (33*a*) that is located in the rod of the piston, whereby this pipe is equipped with a non-return valve.

* * * * *